US005839254A

United States Patent [19]

Chen

[11] Patent Number: 5,839,254

[45] Date of Patent: Nov. 24, 1998

[54] FOLDING AND DELIVERY DEVICE FOR DOUBLE-LAYERED CARTON SEALING MACHINE

[75] Inventor: Tuan-Mei Chiu Chen, Chia-Yi Hsien, Taiwan

[73] Assignee: Tien Heng Machinery Co. Ltd., Hsien, Taiwan

[21] Appl. No.: 871,838

[22] Filed: Jan. 6, 1998

[51] Int. Cl.[6] ..... B65B 7/20

[52] U.S. Cl. ..... 53/377.2; 53/136.4

[58] Field of Search ..... 53/377.2, 377.3, 53/376.4, 491, 378.3, 382.2, 382.3, 136.4

[56] References Cited

U.S. PATENT DOCUMENTS

| | | | |
|---|---|---|---|
| 3,894,380 | 7/1975 | Poulsen | 53/377.2 X |
| 4,218,862 | 8/1980 | Marchetti | 53/377.2 |
| 4,262,468 | 4/1981 | Marchetti | 53/377.2 X |
| 5,115,625 | 5/1992 | Barbulesco et al. | 53/491 X |
| 5,255,490 | 10/1993 | Chiu | 53/377.2 X |
| 5,685,814 | 11/1997 | Le | 53/377.2 X |

*Primary Examiner*—James F. Coan
*Attorney, Agent, or Firm*—Rosenberg, Klein & Bilker

[57] ABSTRACT

A sealing and delivery device for double-layered carton sealing machine includes two folding units, two lifting devices, a front swing unit, two side swing units, a rear swing unit, a conventional roller unit, a conventional platform, and a conventional upper and lower sealing device. The folding units protrude in an aperture between a front flap and two side flaps of an outer box moving on the platform, and swing the two side flaps outward. The lifting devices clamp the outer box and lift it up to a preset level. Two flat plates are pushed to contact elastically two sides of an inner box and support the bottom of the outer box to prevent it from falling down. Then the carton is moved forward in that position for the front swing unit, the side swing units, and the rear swing unit to fold the front, the rear and the two side flaps, which are then sealed by the upper and the lower sealing device.

1 Claim, 12 Drawing Sheets

F I G .1

FOLDING AND DELIVERY DEVICE FOR DOUBLE-LAYERED CARTON SEALING MACHINE

BACKGROUND OF THE INVENTION

This invention concerns a folding and delivery device for double-layered carton sealing machine, particularly lifting an outer box to a preset level and delivered for automatically folding flaps of a carton and then sealing them.

A known conventional sealing and delivery device for double-layered carton sealing machine disclosed in U.S. patent Ser. No. 5,255,490 includes a platform 11, a roller unit 12, a top folding device 13, an upper sealing device 14, a lower sealing device 15, brackets 16, and a lifting device 17 combined together, as shown in FIGS. 17, 18 and 19.

A carton moved on the platform 11 is manually lifted a little to let the brackets 16 clamp the carton and lifted to a preset level by the two lifting devices 17, with limiting rollers 171 and elongate pushing boards 172 clamping the carton 101 and lifting it by means of an air cylinder 173. When the carton moves below the top folding device 13, a front flap 103, a rear flap 104, and two side flaps 105 are gradually folded down inward by a pivotal rocker arm 131, a guide plate 132 and two bent pressing rods 133 and then the carton further moved into the upper and the lower sealing device 14 and 15 to receive sealing operation.

The aforesaid sealing and delivery device for double-layered carton sealing machine has been found the disadvantages as follows in its use.

1. An outer box is clamped with limiting rollers and elongate pushing boards and then lifted, hardly secured in its lifting process, resulting in failure in folding process by the top folding device, wasting time, lowering productive effect.

2. The outer box is clamped at its level by the limiting rollers, impossible to be secured at the level, and if clamped too slack, the carton may fall down with its own weight, and if clamped too tight, fruit contained therein may be hurt, resulting in large loss.

3. The top folding device does not often carry out its operation smoothly for folding a front flap and a rear flap, resulting in high percentage of failure.

SUMMARY OF THE INVENTION

The purpose of the invention is to offer a folding and delivery device improved for double-layered carton sealing machine.

One feature of the invention is two folding units including two guide rods for swinging outward two side flaps of an outer box of a double-layered carton, and two lifting devices for clamping and lifting the outer box to a preset level and then moved at that level for the front flat, the side flaps and a rear flap folded down and then sealed by a conventional upper sealing and a conventional lower sealing device.

Another feature of the invention is a front swing unit and a rear swing unit both disposed in an upper case for swing upward a front flap and a rear flap and then folded down by two side swing units so as to facilitate subsequent sealing operation by the conventional upper and lower sealing device.

BRIEF DESCRIPTION OF DRAWINGS

This invention will be better understood by referring to the accompanying drawings, wherein:

FIG. 18 is a side view of a lifting device of the known conventional sealing And delivery device for double-layered carton sealing machine; and.

DESCRIPTION OF THE PREFERRED EMBODIMENT

Figure 1:
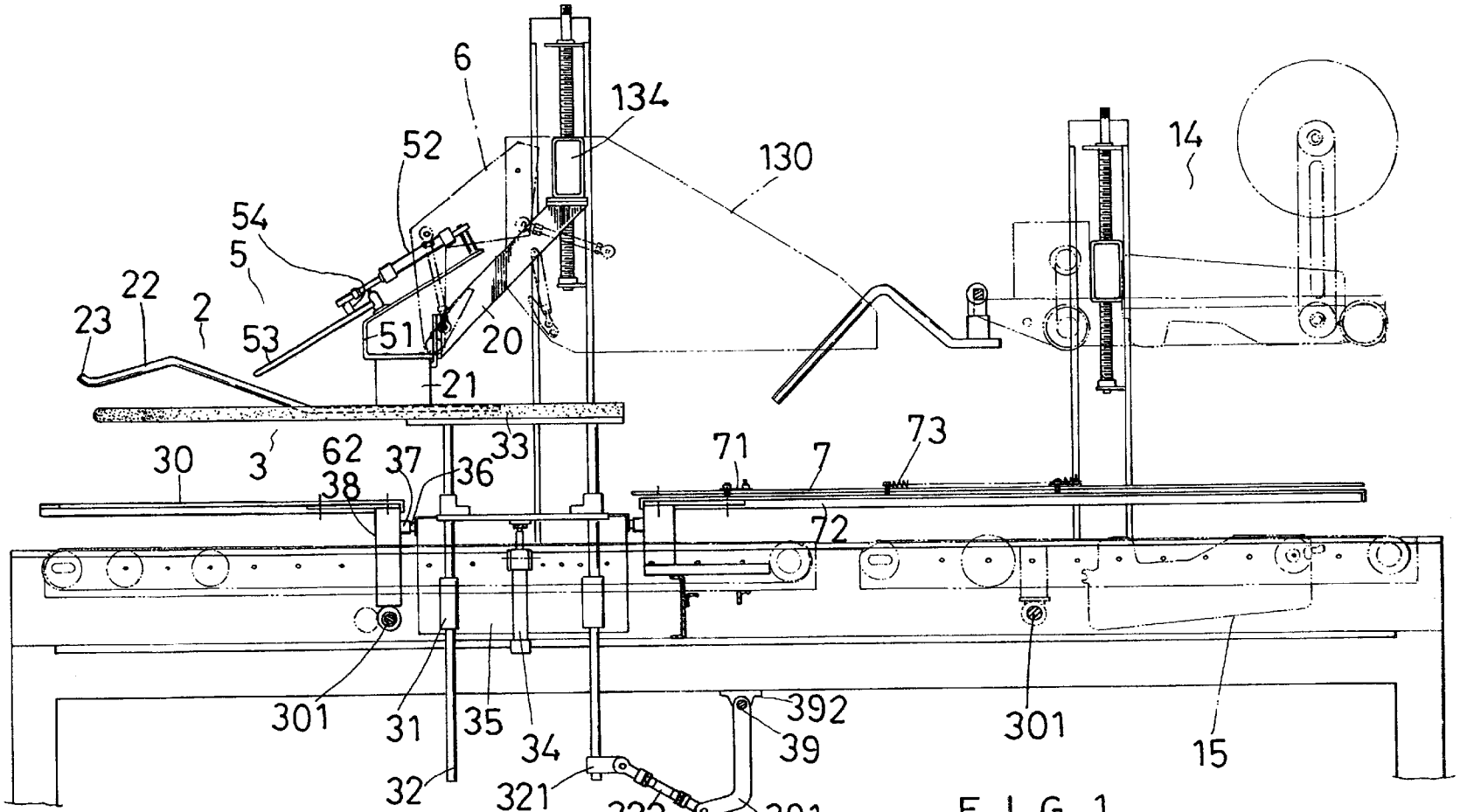
FIG. 1 is a side view of a sealing and delivery device for double-layered carton sealing machine in the present invention.
Figure 2:
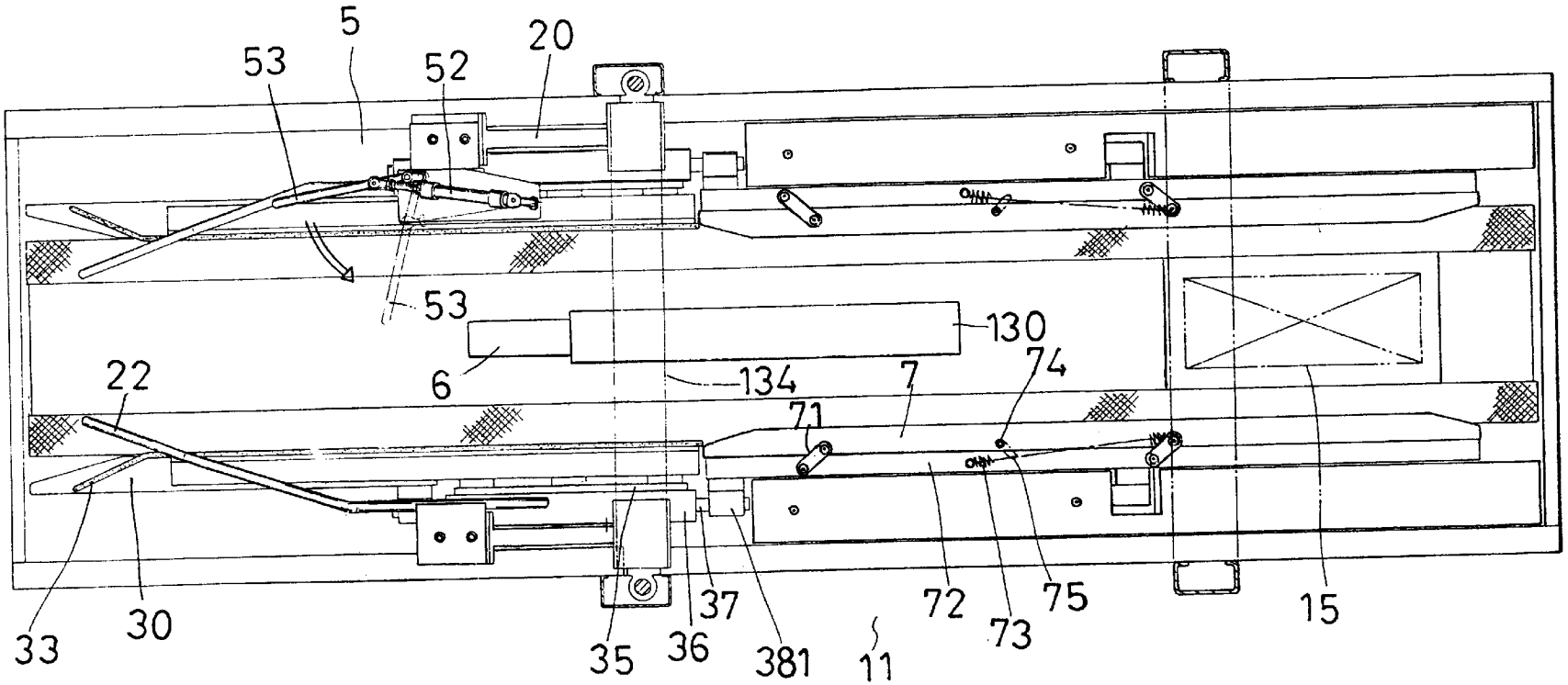
FIG. 2 is an upper view of the sealing and delivery device for double-layered carton sealing machine in the present invention.
Figure 3:
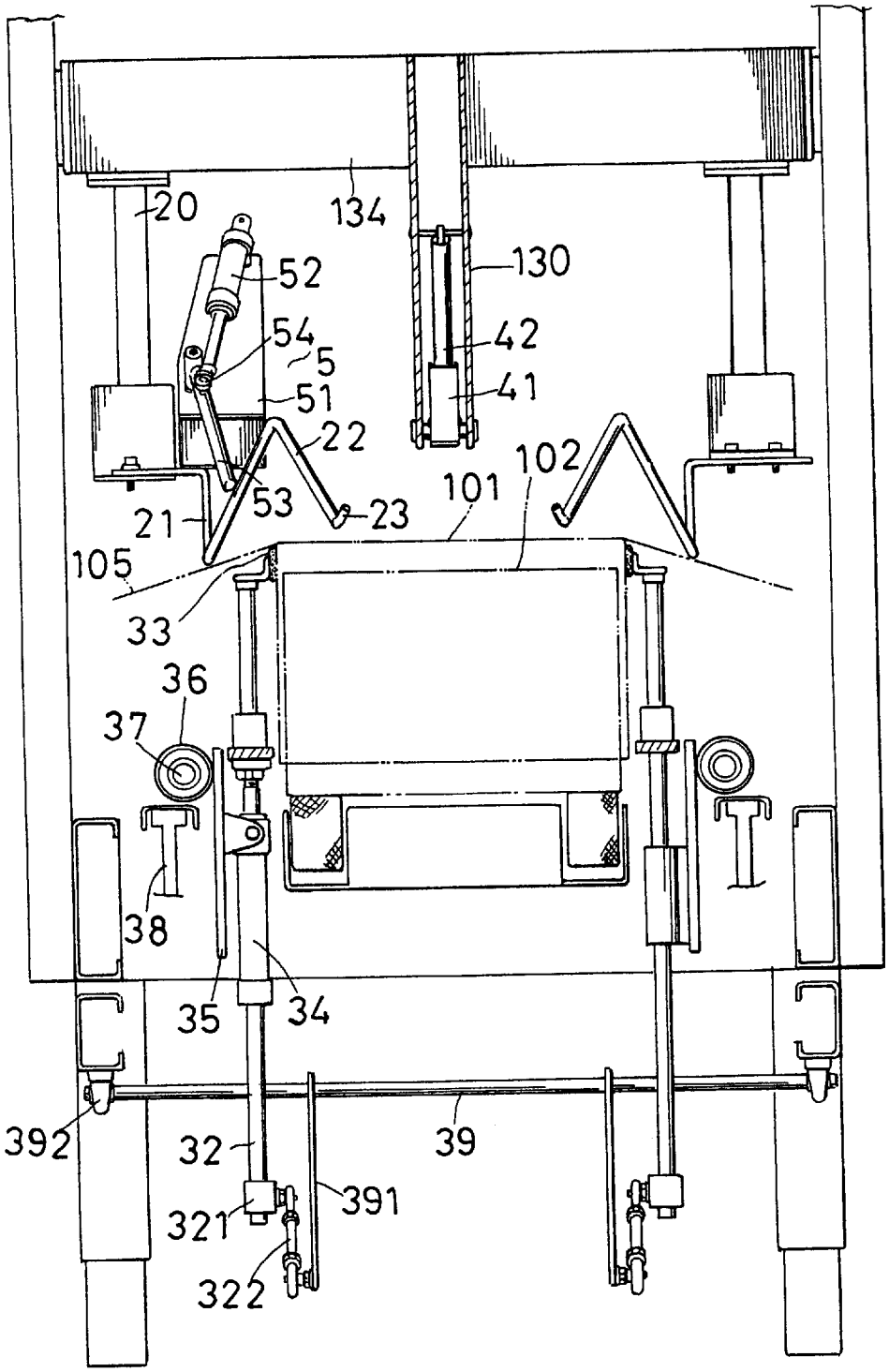
FIG. 3 is a side cross-sectional view of the sealing and delivery device for double-layered carton sealing machine in the present invention.

A preferred embodiment of a sealing and delivery device for double-layered carton sealing machine in the present invention, is shown in FIGS. 1, 2 and 3, includes two folding units 2, two lifting devices 3, a front swing unit 4, two side swing unit 5, a rear swing unit 6, two flat plate 7, a conventional roller unit 12, a conventional upper,sealing device 14 and a conventional lower sealing device 15 combined together.

Each folding unit 2 has two guide plates 21. 21 each fixed under a slanting rod 20 fixed with each of two ends of a horizontal rod 134 of an upper case 130, and an inverted V-shaped guide rod 22 connected with an inner bottom of the guide plate 21. Each guide rod 22 has an outer curved end 23 for smoothly moving through an aperture between two upper flaps of a carton.

Figure 6:
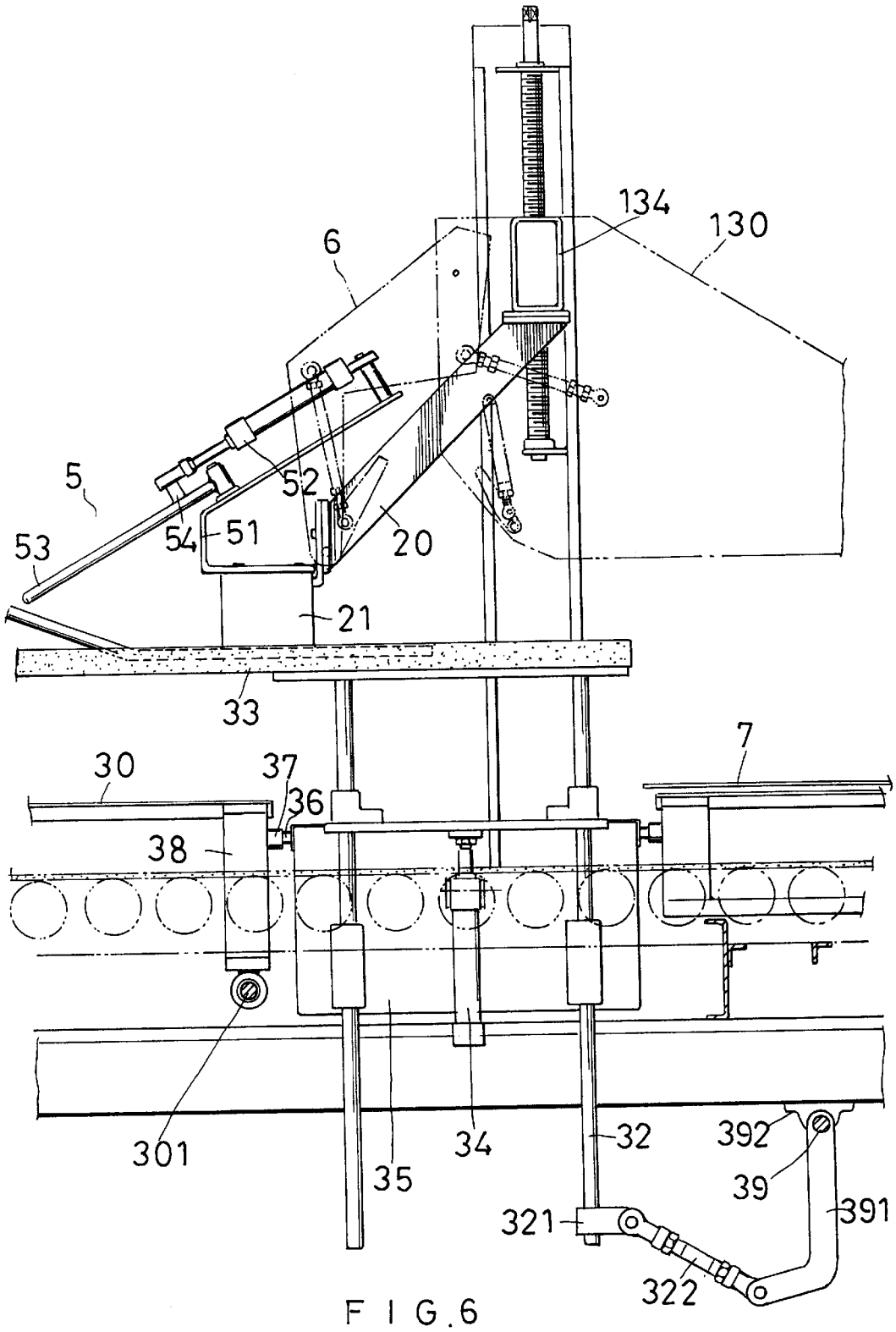
FIG. 6 is a partial cross-sectional view of the sealing and delivery device for double-layered carton sealing machine in the present invention.
Figure 7:
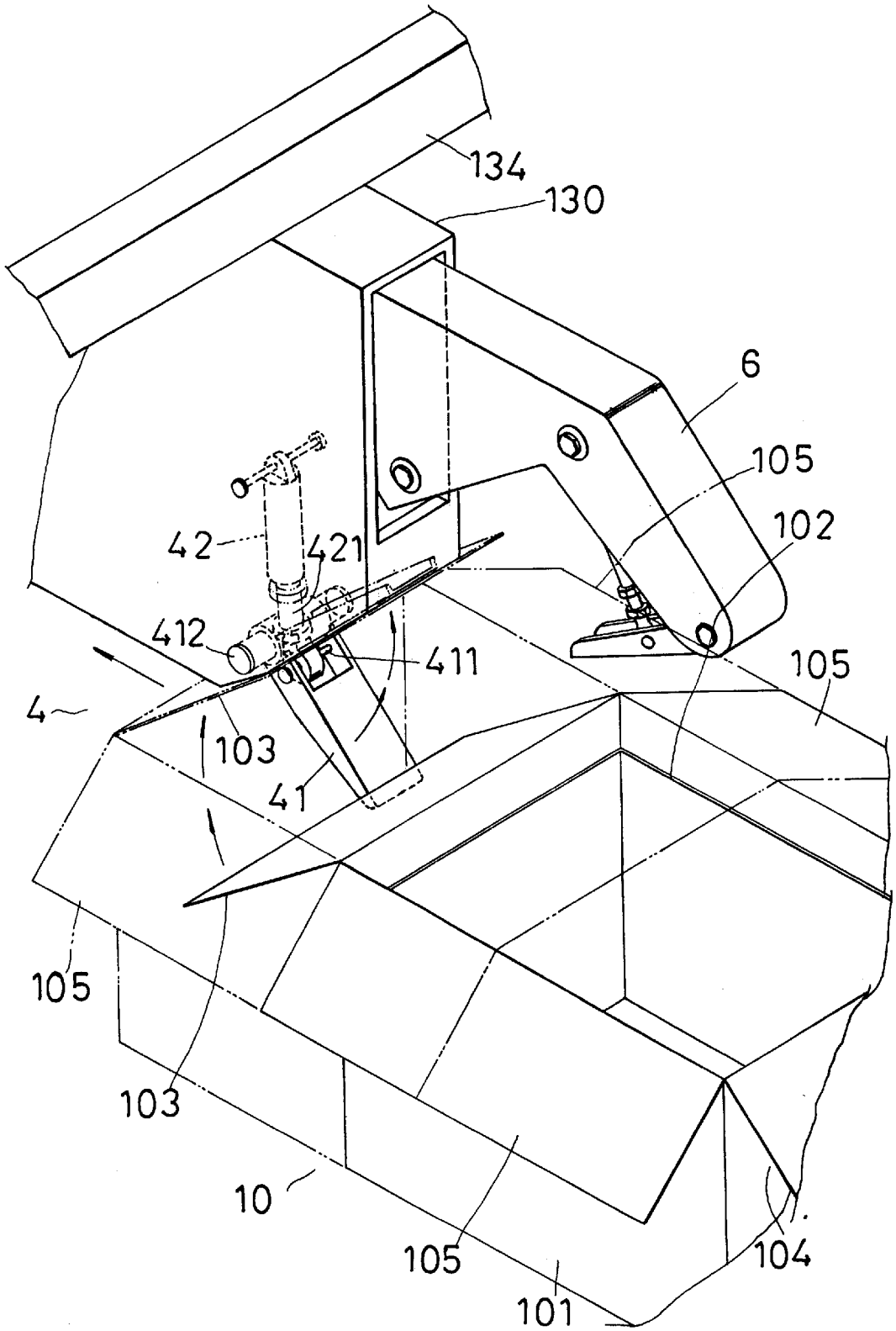
FIG. 7 is a perspective view of a front swing unit in the present invention, showing it moving a front flap of a carton.
Figure 9:
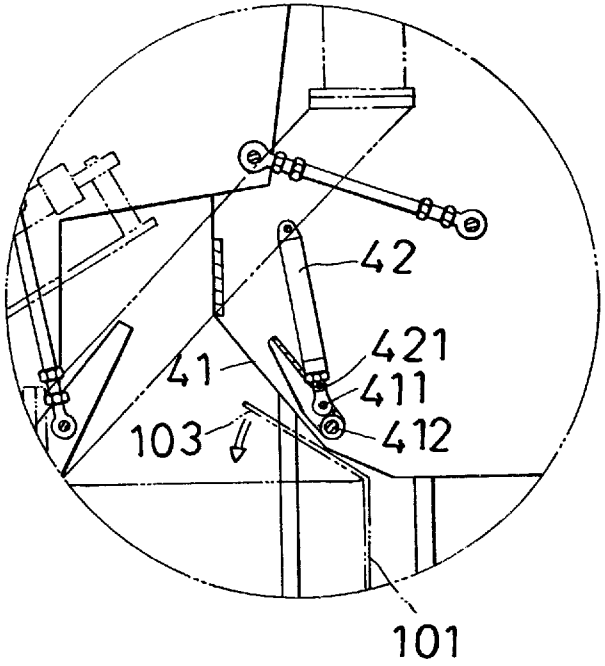
FIG. 9 is a part cross-sectional view of the front swing unit in the present invention, showing it pressing down the front flap.
Figure 8:
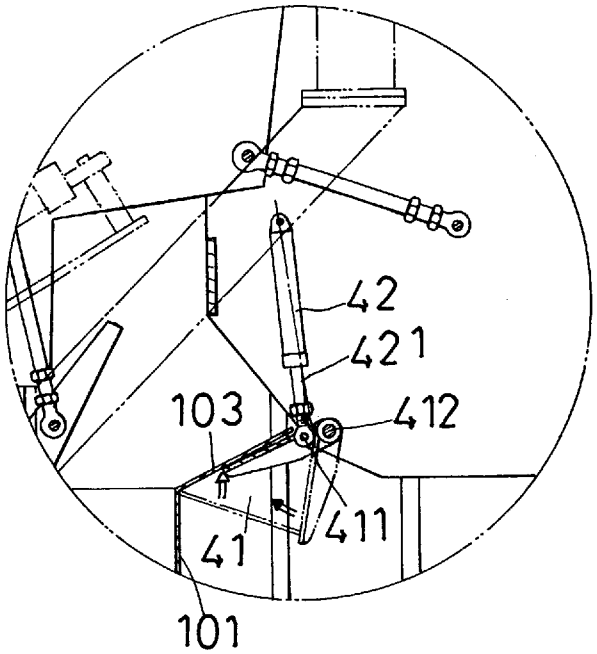
FIG. 8 is a part cross-sectional view of the front swing unit in the present invention, showing it further folding the front flap.

Each lifting device 3 has a sleeve 31 respectively in a front and a rear portion, an upright rod 32 fitting in each sleeve 31, a lifting frame 33 laterally connected with an upper end of each upright rod 32, and a first air cylinder 34 connected vertically with the upright rod 32 so as to lift and lower the lifting rod 33. The sleeve 31 has a plate 35, and a cylindrical member 36 fixed on an vertical side of an upper end of the plate 35, a shaft 37 contained in the cylindrical member 36 and fitted in a shaft support 381 of a stationary frame 38. Then the whole lifting device 3 can sway a little so as to cope with cartons having small size difference so that an outer box may be lifted owing to looseness between an inner box and an outer box partly caused by vibrations by each first air cylinder 34. Further, each upright rod 32 is connected with a connect rod 322 through a block 321. The other end of the connect rod 322 is connected with a crank 391 of a horizontal rod 39 pivotally connected with a bearing base 392 fixed under the platform 11 so that the two lifting devices 3, 3 may move together synchronously, as shown in FIGS. 1, 3 and 6. Further, the stationary frame 38 in front of each lifting device 3 has a limit frame 30 moved by a left or a right threaded rod 301, for guiding a carton forward by moving inward or outward.

The front swing unit 4 is disposed in the upper case 13, consists of a folding plate 41, and a second air cylinder 42 connected with the folding plate 41. An upper end of the second air cylinder 42 is pivotally connected with a pin fixed with the upper case 130 and an output shaft 421 of the second air cylinder 42 is pivotally connected with a rod 411 in the folding plate 41 so as to swing the folding plate 41 up and down with a support shaft 412 as a pivot.

Figure 10:
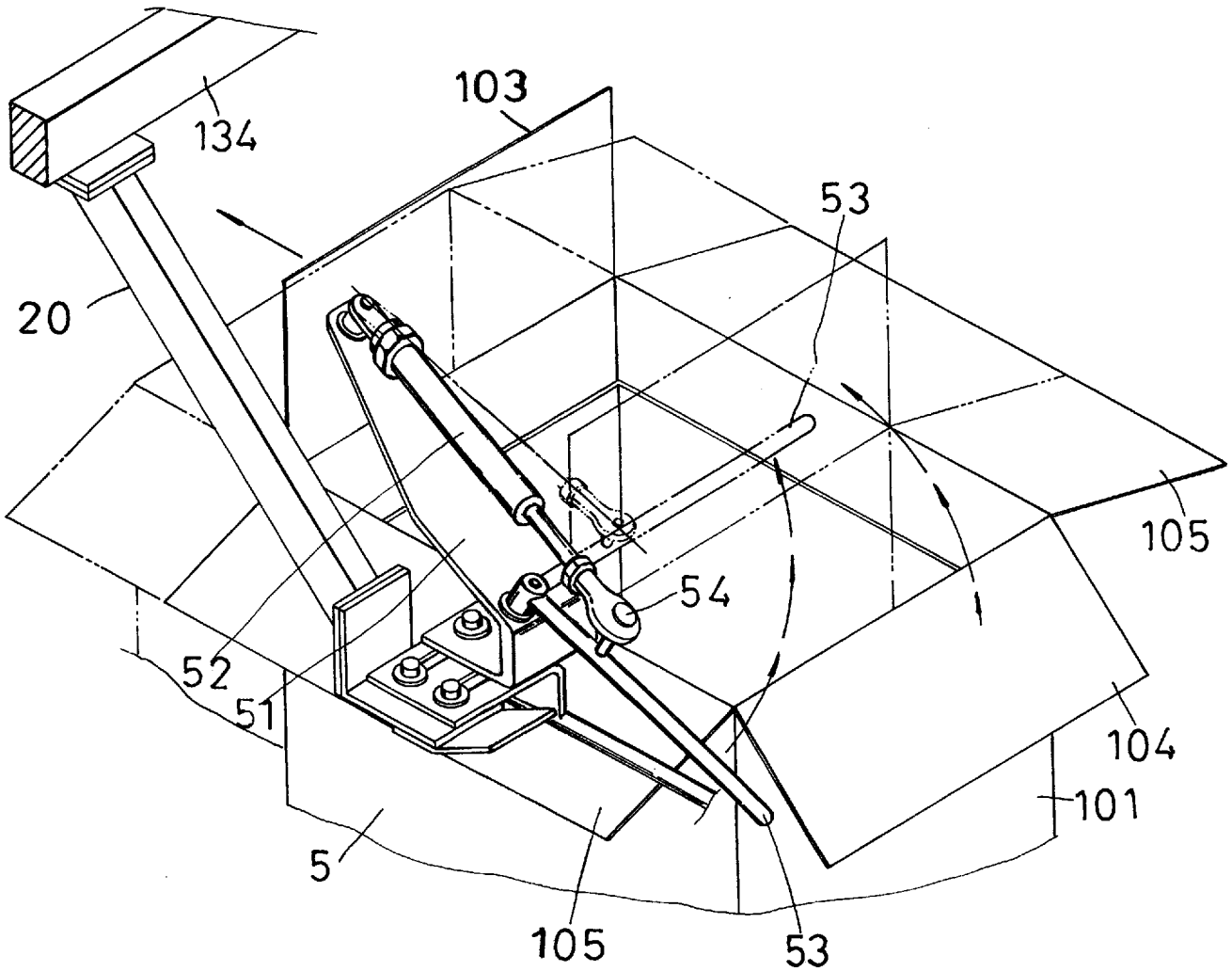
FIG. 10 is a perspective view of a side swing unit in the present invention, showing its swinging direction.

Each side swing unit 5 consists of a plate 51 fixed at a bottom of the slanting rod 20, a third air cylinder 52 pivotally connected with the plate 51, a swing rod 53 also pivotally connected with the plate 51, a shaft 54 fixed with the swing rod 53 and pivotally connected with and controlled by the third air cylinder 52 so that the swing rod 53 may sway inward and outward, with its outer end contacting a lower portion of a rear flap 104 in due time and the pushing it upward a little to a preset level, as shown in FIG. 10.

Figure 11:
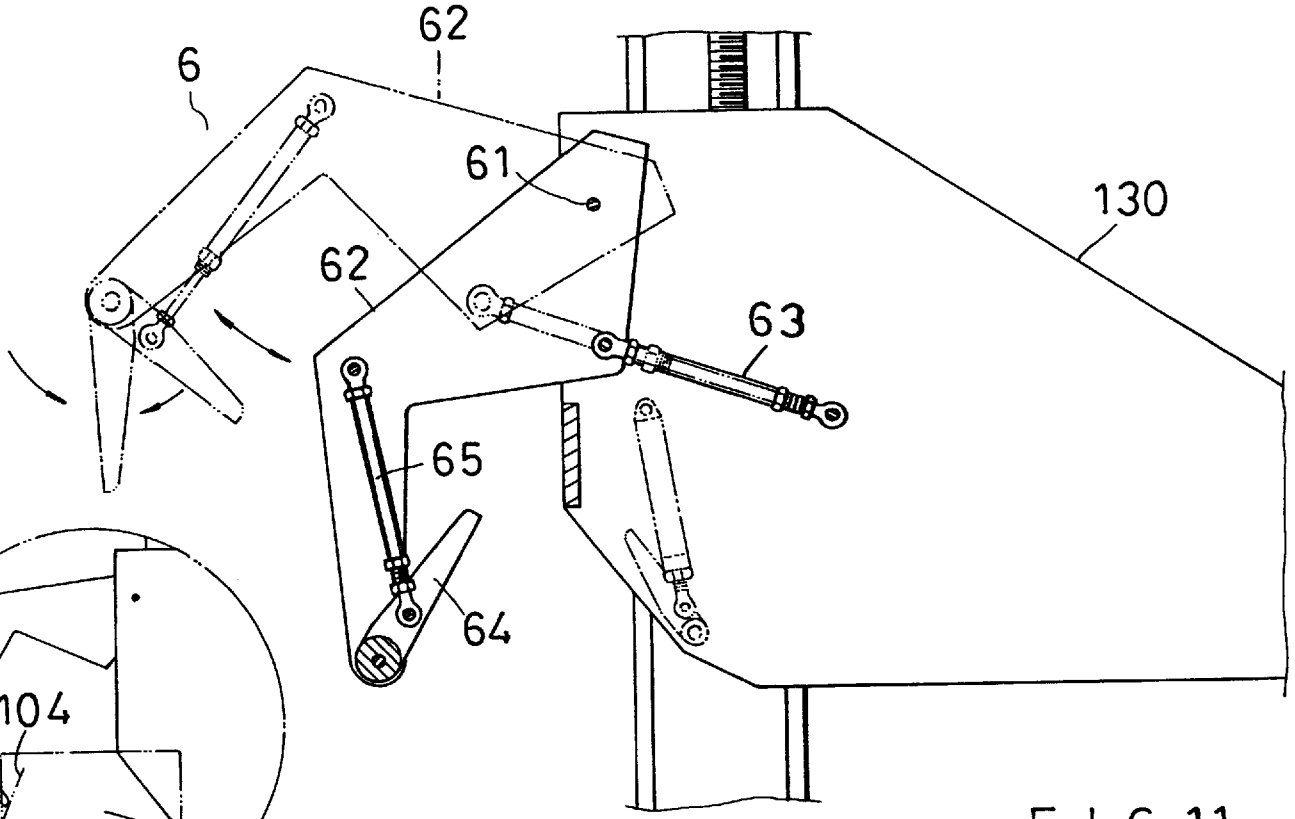
FIG. 11 is a perspective view of a rear swing unit in the present invention, showing its swinging direction.
Figure 12:
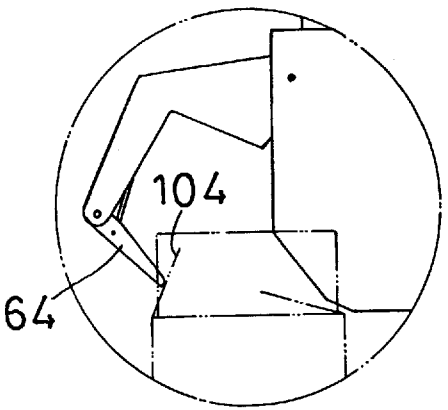
FIG. 12 is a perspective view of the rear swing unit in the present invention, showing it moving a rear flap.
Figure 13:
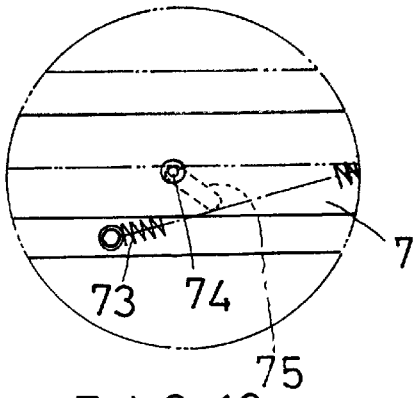
FIG. 13 is an upper partial view of a flat plate in the present invention.
Figure 14:
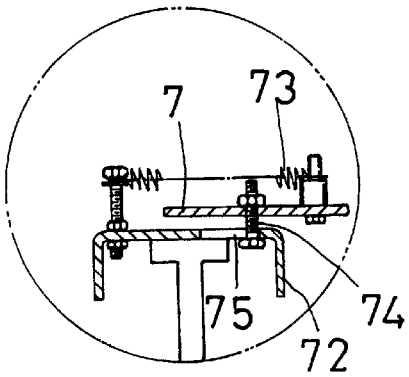
FIG. 14 is a side view of the structure of the flat plate in the present invention.
Figure 15:
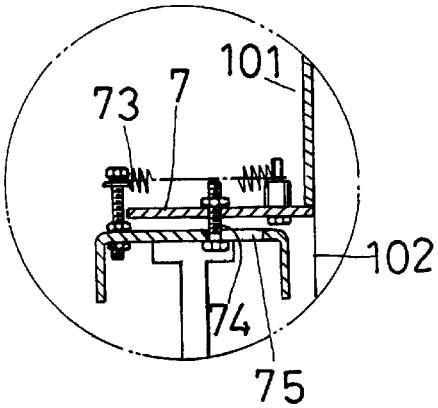
FIG. 15 is another side view of the structure of the flat plate in the present invention, showing a threaded rod moved in a slot.
Figure 16:
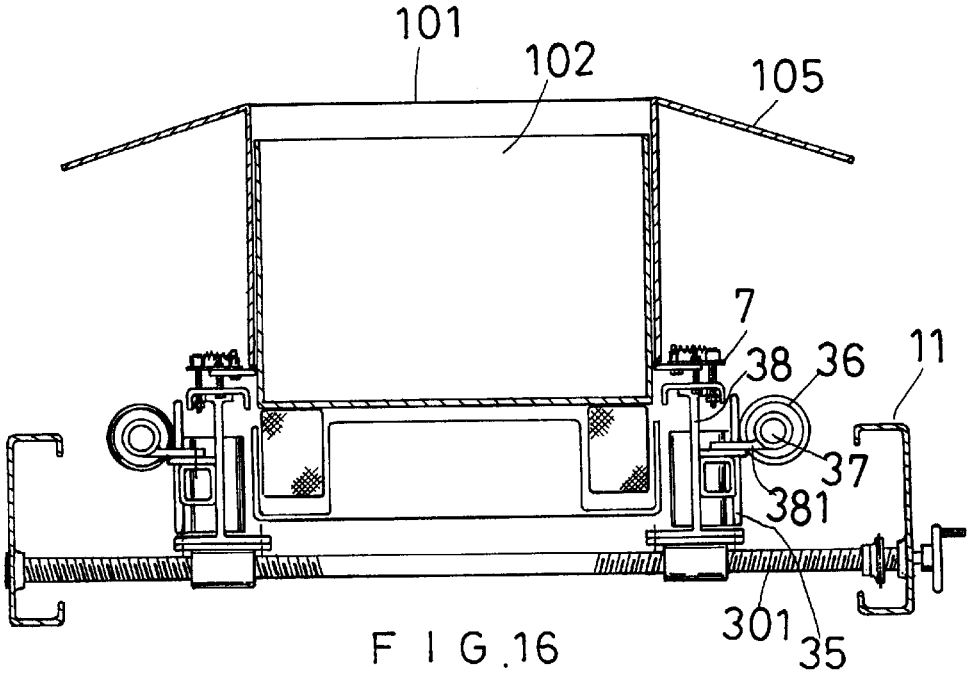
FIG. 16 is a side view of the whole flat plate in the present invention.
Figure 17:
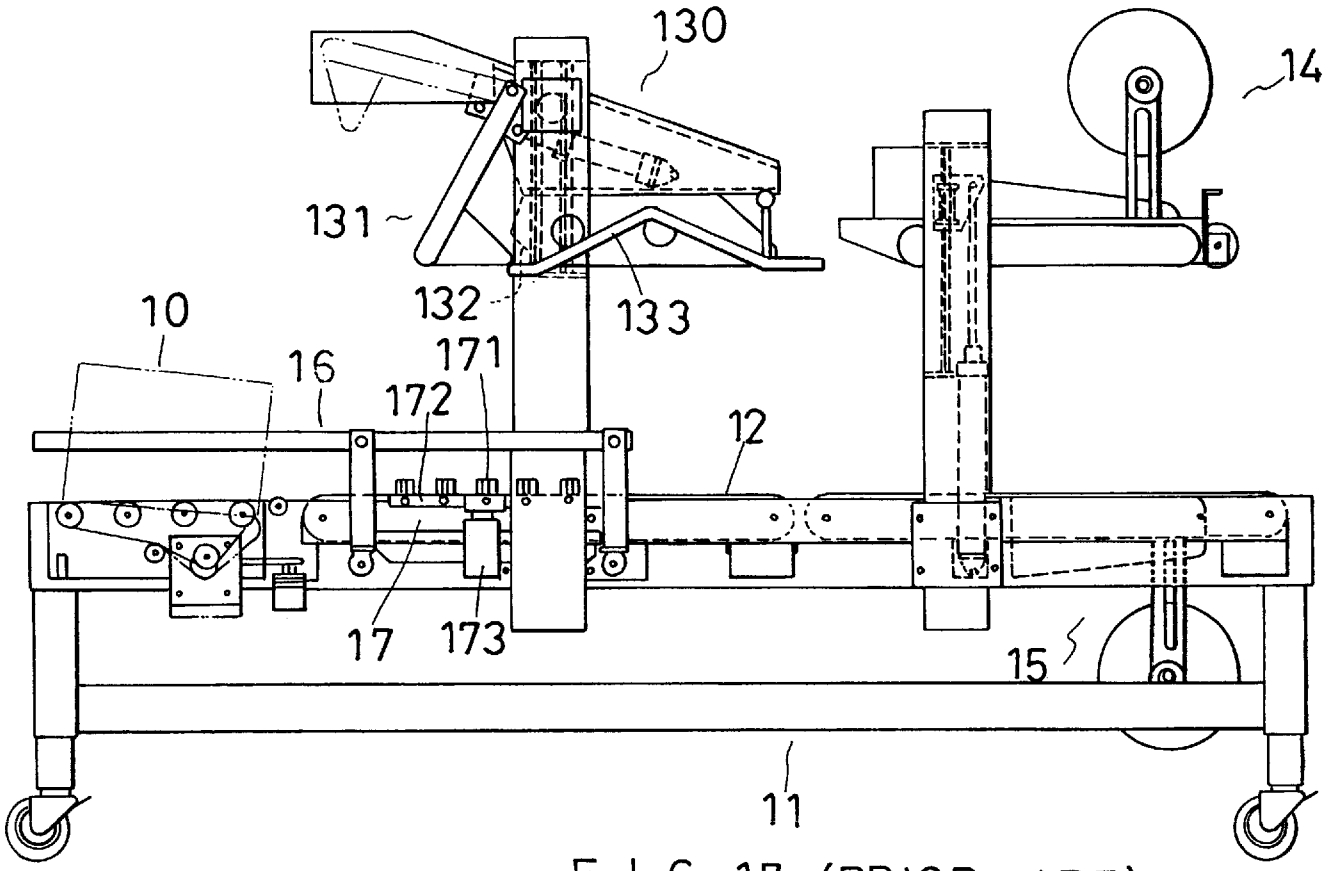
FIG. 17 (PRIOR ART)
FIG. 17 is a side view of a known conventional sealing and delivery device for double-layered carton sealing machine.
Figure 18:
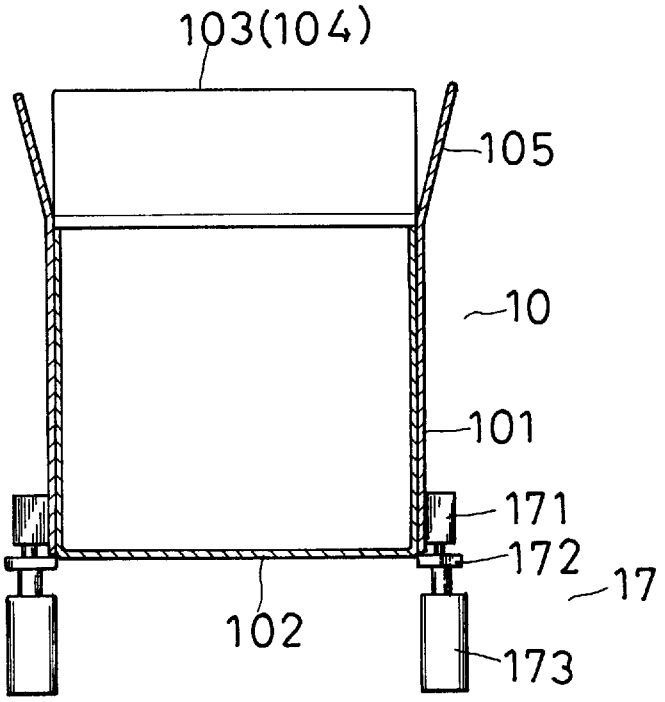
FIG.18 (PRIOR ART)
Figure 19:
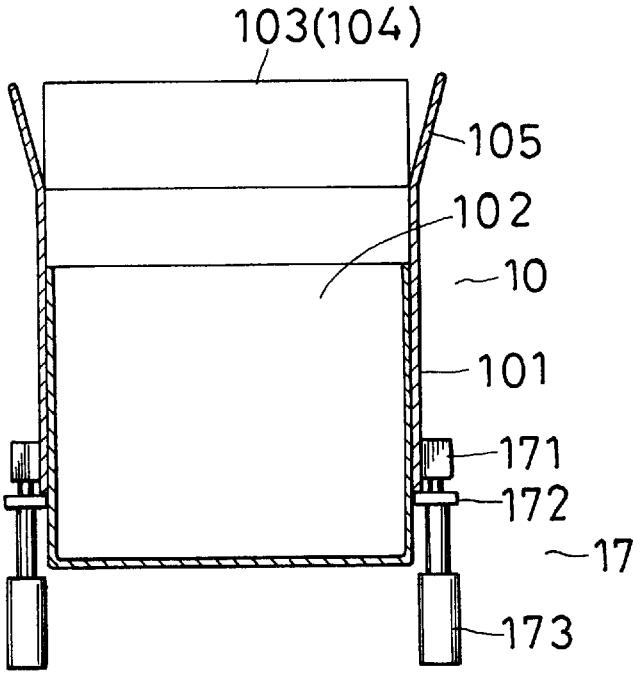
FIG.19 (PRIOR ART)
FIG. 19 is a side view of the lifting device of the known conventional sealing and delivery device for double-layered carton sealing machine, showing it lifting an outer box of a double-layered carton.

The rear swing unit 6 is disposed in the upper case 130, consisting of a rod 61, a movable plate 62 pivotally connected with the rod 61, a fourth air cylinder 63 for moving the folding rod 62, a swing arm 64, a fifth air cylinder 65 connected with the swing arm 64 and moved by the movable plate 62 to extend to push the rear flap 104 forward and fold it down so that the two side flaps 104, 104 may be folded down smoothly for sealing operation, as shown in FIGS. 11 and 12.

Two flat plates 7, as shown in FIGS. 1, 2, 12, 13, 14 and 15, respectively is pivotally connected with the stationary frame 72 fixed on the platform 11 via a connecting rod 71, a spring 73 provided to pull elastically the connecting rod 71. A threaded rod 74 is provided to be fixed with the flat plate 7 and protruding through a slot 75 of the stationary frame 72 so as to permit the flat plate 7 move within the length of the slot 75.

Figure 4:
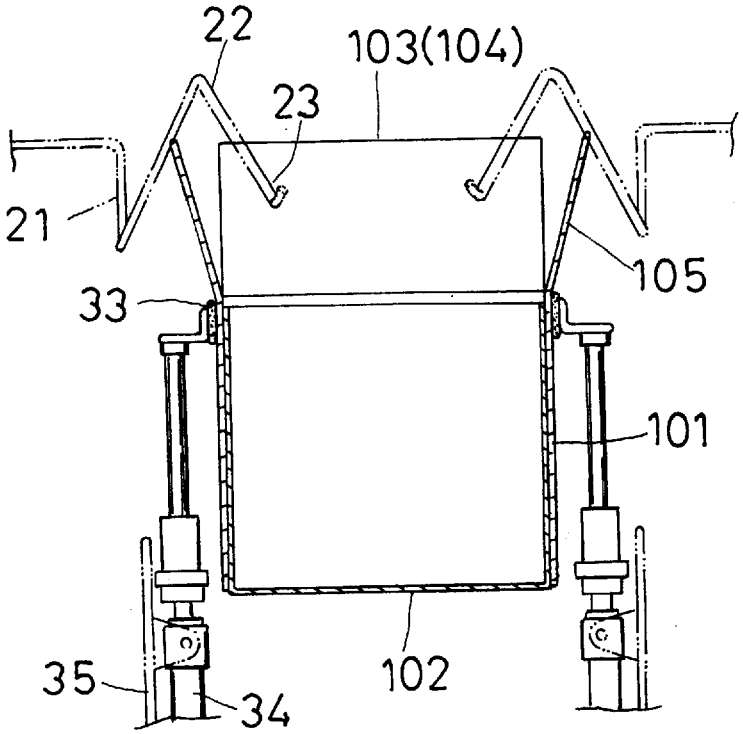
FIG. 4 is a side view of two lifting devices and two folding units of the sealing and delivery device for double-layered carton sealing machine in the present invention, showing them in folding movement.
Figure 5:
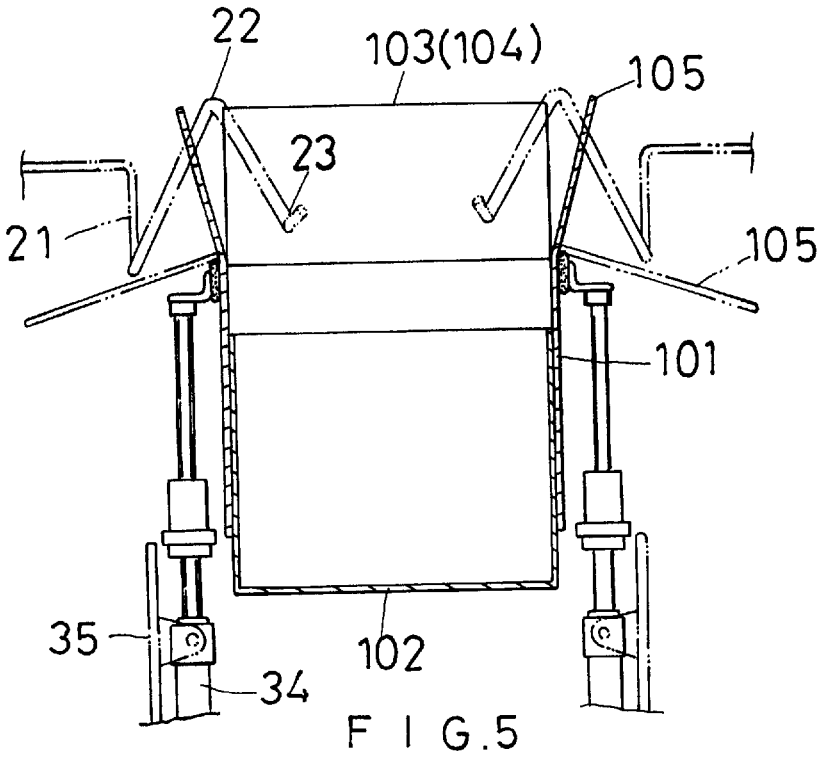
FIG. 5 is a side view of the lifting devices and the folding units of the sealing and delivery device for double-layered carton sealing machine in the present invention, showing them in another folding movement.

As to the operation of this sealing and delivery device for a double-layered carton, after a double-layered carton 10 having an inner box 102 and an outer box 103 is placed to move on the platform 11, the curved ends 23, 23 of the two guide rods 22, 22 protrude in an aperture between the front flap 103 and a side flap 105, guiding the two side flaps 105, 105 to be gradually swung up to move into the guide plate 21 as shown in FIGS. 4, 5. Meanwhile, the first air cylinders 34 move to lift the lifting frame 33 and clamp the outer box 101 at the folding lines of the side flaps 105, 105 and lift the outer box 101 to a preset level as shown in FIG. 5. Then a front flap 103 moving under the upper case 130 is moved by the folding plate 41 from under upward to be folded smoothly down inward the outer box 103.

Then further, a rear flap 104 contacts in due time with the outer end of the swing rod 53 of the side swing unit 5, is gradually swung upward to a preset level, and then in due time, pressed down forward by the swing arm 64 of the movable plate 62 of the rear swing unit 6 so as to permit the two side slips 105, 105 folded down inward smoothly.

After that, the carton 100 continues to move forward and the two flat plates 7, 7 will contact the two sides of the inner box 102 and support the bottom edge of the outer box 101 lest the outer box 101 should fall down, permitting the carton kept moving forward at the same level. After the outer box 101 is carried by the flat plates 7, 7, then it is sealed by the upper and the lower sealing device 14 and 15.

Compared with the conventional sealing and delivery device for double-layered carton sealing machine, the present invention has the advantages as follows.

1. As an outer box of a double-layered carton is lifted to a preset high level, the carton may have a larger space so that fruit contained in the carton may not be pressed to be hurt in sealing process and then sealed by an upper and a lower sealing machine.

2. The lifting frame of the lifting device can clamp the outer box at two sides for lifting it up, after the two side flaps are folded outward, ensuring lifting process of the outer box without failure.

3. Forward folding of the rear flap of a carton is performed by two units synchronously, so failure in its folding process can be reduced to the minimum.

4. The swing arm of the side swing unit pushes easily upward the drooping rear flap of the carton after contacting the carton, to an upright position and then able to fold it inward in the carton, with permissible difference in its height being large so that different height and size of cartons may be compensated.

5. Utilization of the folding rod makes it possible to push drooping flaps of different thickness and hardness to an upright position, preventing a drooping rear flap from not being folded inward the carton.

6. The two flat plates have a certain elasticity to clamp the inner box and support the lower edges of the outer box after the outer box is lifted so that the outer box is prevented from dropping down and kept at the lifted height in movement for subsequent folding and sealing processes.

While the preferred embodiment of the invention has been described above, it will be recognized and understood that various modifications may be made therein and the appended claims are intended to cover all such modifications which may fall within the spirit and scope of the invention.

What is claimed is:

1. A sealing and delivery device for double-layered carton sealing machine comprising:

two folding rod units respectively consisting of a guide plate and a guide rod, each said guide plate shaped as an inverted L and fixed under a lateral rod of an upper case, each said guide rod fixed under said guide plate and extending forward;

two lifting devices respectively consisting of a sleeve, an upright rod, a lifting frame and a first air cylinder, said sleeve fixed with a platform and inserted through by said upright rod to let said rod to slide up and down, an upper end of said upright rod fixed with said lengthwise lifting frame, said first air cylinder moving up and down said upright rod for lifting and lowing said lifting frame, a plate fixed with said sleeve having a cylindrical member fixed at two sides, a shaft fitted in said cylindrical member and connected with a shaft support of a stationary frame so as to permit said lifting device to move in and out with a proper elasticity to cope with small size difference of cartons, said upright rod having its lower end fixed with a block connected with one end of a connecting rod, the other end of said connecting rod connected with a crank of a synchronous horizontal rod pivotally fixed with a bearing base fixed under said platform so that said two lifting devices may be moved up and down simultaneously;

a front swing unit disposed in said upper case, consisting of a folding plate and a second air cylinder, said second air cylinder having its upper end pivotally connected with a rod fixed between two opposite sides of said upper case and a piston rod pivotally connected with a rod of said folding plate so as to permit said folding plate to swing up and down by means of a support shaft as a pivot;

two side swing units respectively consisting of a plate provided under a slanting rod, a third air cylinder pivotally attached on said plate, a swing rod also pivotally attached on said plate, said swing rod having a shaft at a proper location, said shaft pivotally connected with and moved by said third air cylinder so as to move said swing rod so that an outer end of said swing rod may contact a lower portion of a rear flap of a carton and then push up said rear flap to a preset level;

a rear swing unit disposed in said upper case, consisting of a rod pivotally connected with a movable plate, a fourth air cylinder moving said movable plate, a swing arm fixed with a lower end of said movable plate, a fifth air cylinder fixed on said movable plate and having its piston rod end pivotally connected with an intermediate portion of said movable plate, said swing arm moved by said fifth air cylinder to push the drooping rear flap upward and then to fold forward so that two side flaps may be folded down for sealing;

two flat plates respectively pivotally connected with a stationary frame on said platform with a connecting rod, a spring used to pull said flat plate with elasticity, a threaded rod provided to screw said flat plate with stationary frame and protruding in a slot in said stationary frame so that said flat plate may move within the length of said slot; and, said two guide rods with their outer ends passing through an aperture between a front flap and two side flaps of a moving-on carton and forcing said two side flaps to swing outward, said two lifting frames moved by said first air cylinders to clamp two sides of an outer box at the folding lines of said side flaps and lift said outer box up to a preset level, said two flat plates moved to contact two sides of an inner box and support lower edges of said outer box to prevent said outer box from falling down, said front swing unit and said side swing units firstly folding inward down the front flap, the rear flap, said rear swing unit further folding the side flaps inward down during forward movement of said carton, and said moving carton finally sealed by said upper and said lower sealing device.

* * * * *